US006167700B1

(12) United States Patent
Lampert

(10) Patent No.: US 6,167,700 B1
(45) Date of Patent: Jan. 2, 2001

(54) EXHAUST SYSTEM FOR AN INTERNAL COMBUSTION ENGINE

(76) Inventor: Jeff Lampert, 2160 E. Fry Blvd., #434, Sierra Vista, AZ (US) 85635

( * ) Notice: Under 35 U.S.C. 154(b), the term of this patent shall be extended for 0 days.

(21) Appl. No.: 09/301,513

(22) Filed: Apr. 28, 1999

(51) Int. Cl.[7] ..... F01N 3/10

(52) U.S. Cl. ..... 60/307; 60/308; 60/312; 60/313

(58) Field of Search ..... 60/307, 308, 312, 60/313

(56) References Cited

U.S. PATENT DOCUMENTS

| | | | | |
|---|---|---|---|---|
| 1,244,442 | | 10/1917 | Frazer . | |
| 1,864,915 | * | 6/1932 | Kosterman | 60/307 |
| 2,161,895 | | 6/1939 | Brenner . | |
| 2,211,795 | | 8/1940 | Sauer . | |
| 2,263,407 | * | 11/1941 | Kittell, Sr. | 60/308 |
| 2,450,212 | * | 9/1948 | Thomas | 60/308 |
| 2,522,883 | | 9/1950 | MacArthur . | |
| 2,667,031 | | 1/1954 | Ryder . | |
| 2,812,634 | | 11/1957 | Haring . | |
| 2,829,731 | * | 4/1958 | Clayton | 60/308 |
| 3,022,934 | * | 2/1962 | Gerald | 60/308 |
| 3,214,902 | * | 11/1965 | Maring | 60/307 |
| 3,300,964 | | 1/1967 | Knopp . | |
| 3,470,689 | | 10/1969 | Gurr . | |
| 3,485,039 | * | 12/1969 | Wehinger | 60/308 |
| 3,741,730 | * | 6/1973 | Alcott | 60/301 |
| 4,313,523 | | 2/1982 | Copen . | |
| 4,418,532 | | 12/1983 | Momose et al. . | |
| 5,282,361 | | 2/1994 | Sung . | |
| 5,524,434 | | 6/1996 | Ma . | |

FOREIGN PATENT DOCUMENTS

| | | | |
|---|---|---|---|
| 603993 | | 11/1975 | (CH) . |
| 3640290 | | 11/1986 | (DE) . |
| 1008190 | | 1/1950 | (FR) . |
| 865822 | | 8/1958 | (GB) . |
| 56-88910 | | 7/1981 | (JP) . |
| 0194025 | * | 11/1984 | (JP) 60/308 |

* cited by examiner

*Primary Examiner*—Thomas Denion
*Assistant Examiner*—Diem Tran

(57) ABSTRACT

An exhaust system for an internal combustion engine. A plenum chamber has two ports, one which is connected to a header tube for conducting a stream of exhaust gas and another which is connected to a ram tube adapted to collect outside air provided by movement of a vehicle in which the internal combustion engine is installed. The plenum chamber is constructed so that the outside air is caused to travel thereinside at least a substantially non-zero set-back distance before being permitted to join the stream of exhaust gas. Preferably, the exhaust system also includes one or more reverse flow controllers associated with respective cylinders of the internal combustion engine, downstream from the exhaust ports thereof.

16 Claims, 2 Drawing Sheets

EXHAUST SYSTEM FOR AN INTERNAL COMBUSTION ENGINE

BACKGROUND OF THE INVENTION

This invention relates to an exhaust system for an internal combustion engine, particularly for installation in a motor vehicle.

The performance and efficiency of internal combustion engines depends heavily on the efficient movement of gases through the engine, from the introduction of air and atomized fuel into the cylinders of the engine, to exhaust of the products of combustion. The exhaust system plays an important role in this performance and efficiency, particularly where it is adapted to provide for low pressure downstream of the cylinders for "scavenging" the exhaust gases from the cylinders. Where scavenging is effective, power loss due to the need to "pump" exhaust gases out of the cylinders is lessened.

One known means for scavenging is to provide a tuned length of exhaust header tube, the length being predetermined in consideration of a desired speed of the engine at which it is desired to produce maximum power or efficiency, so that pressure waves inside the tube reinforce one another to create a low pressure area at the exhaust port at the appropriate time. This approach works well to provide for high performance and efficiency at a particular engine speed, but its effectiveness decreases as engine speed deviates from this value. The approach also demands trade-offs where there are multiple cylinders, unless the expense is undertaken to provide a separate exhaust system for each cylinder.

Another known means for improving exhaust system performance is to reduce back pressure, such as by reworking or eliminating the muffler. Often, however, such means increase noise to the extent that they provide performance or efficiency benefits, and are therefore objectionable for many uses.

Many after-market products are available for increasing exhaust system performance, for use in racing automobiles, motorcycles, speed-boats, and other sporting vehicles. However, the effects of combining these products have not been completely predictable, and there remains a lack of guidance in the art as to what combinations of such products are optimum. Moreover, there will always remain a desire among speed and racing enthusiasts, as well as those interested in achieving optimum fuel economy, to obtain additional improvements.

Accordingly, there is a need for an exhaust system for an internal combustion engine that provides for greater performance and efficiency from an internal combustion engine for use in a vehicle than has heretofore been available.

SUMMARY OF THE INVENTION

The present invention solves the aforementioned problems and meets the aforementioned needs by providing an exhaust system for an internal combustion engine installed in a vehicle comprising a ram tube and a plenum chamber. The internal combustion engine is connected to one or more header tubes adapted to conduct streams of exhaust gas from one or more cylinders of the internal combustion engine. The plenum chamber has at least two ports. A first port of the plenum chamber is adapted for coupling to the outlet end of the ram tube. The ram tube is adapted to collect and conduct outside air through the output end thereof into the plenum chamber as the vehicle moves forwardly. Preferably, the ram tube is funnel-shaped to compress the outside air as it moves toward the plenum chamber wherein, inside the plenum chamber, the air expands.

A second port of the plenum chamber is adapted for coupling to the outlet end of one of the header tubes. The first port is set-back from the second port, with respect to the direction of the stream of exhaust gas, such that outside air conducted by the ram tube is caused to travel inside the plenum chamber at least a substantially non-zero set-back distance before being permitted to join the stream of exhaust gas as it passes through the second port of the plenum chamber. Preferably, the length of the ram tube is substantially less than the length of the header tube.

Preferably, the exhaust system also includes, along with the above, one or more reverse flow controllers associated with respective cylinders of the internal combustion engine, downstream from the exhaust ports thereof.

It is further preferable to employ, in addition to the foregoing, a step increase in the diameter of one or more of the header tubes.

Accordingly, it is a principal object of the present invention to provide a novel exhaust system for an internal combustion engine.

It is another object of the present invention to provide such an exhaust system that provides for improved performance and efficiency in the internal combustion engine.

It is yet another object of the present invention to provide such an exhaust system that provides for improved scavenging of exhaust gases from the internal combustion engine.

It is still another object of the present invention to provide such an exhaust system that provides for improved scavenging of exhaust gases over a broad range of engine speeds.

It is a further object of the present invention to provide such an exhaust system that provides for performance and efficiency improvements while not substantially increasing or decreasing noise.

The foregoing and other objects, features and advantages of the invention will be more readily understood upon consideration of the following detailed description of the invention, taken in conjunction with the following drawings.

DETAILED DESCRIPTION OF A PREFERRED EMBODIMENT

Figure 1:
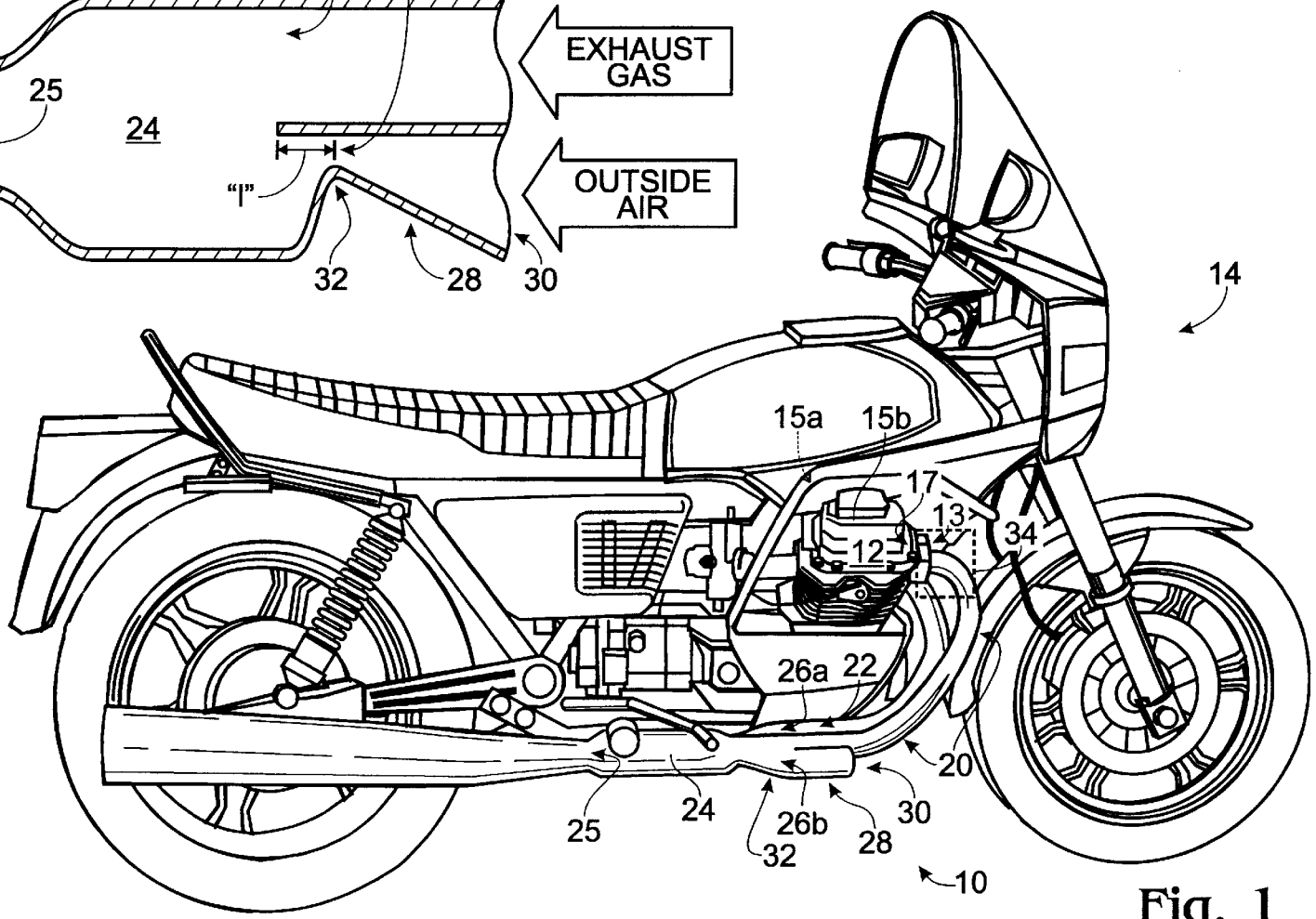
FIG. 1 is a pictorial view of an exhaust system for an internal combustion engine according to the present invention.

FIG. 1 depicts an exhaust system 10 for an internal combustion engine 12, according to the present invention. The internal combustion engine is installed in a vehicle 14 which moves the exhaust system through the atmosphere, generating airflow with respect thereto. The vehicle may be any land, air or sea-going vehicle, such as an automobile, motorcycle, snowmobile, aircraft or water-craft, and the internal combustion engine may have any number of cylinders, including just one cylinder.

As shown in FIG. 1, an exemplary embodiment of the invention is adapted for use in a vehicle 14 that is a motorcycle, particularly for use with an engine 12 that has two combustion chambers ("cylinders") 15*a,* 15*b* and which, typically, is provided from the manufacturer with two independent exhaust systems associated therewith. It will be understood, however, that the features described herein may be adapted for use with any internal combustion engine 12 with any number of cylinders, in any type of vehicle 14.

Each cylinder of the internal combustion engine generally has a relatively short length of tubing; herein "primary tube," that is coupled at an inlet end 13 of the tubing to an exhaust port 17 of the cylinder and extends therefrom to conduct exhaust gas away from the cylinder. In most internal combustion engines, e.g., for service use, the exhaust gas is conducted through a baffled muffler for silencing the rapidly expanding exhaust gas. However, in some internal combustion engines, e.g., for racing use, the exhaust gas may be conducted through unbaffled tubing to reduce back pressure at the cost of increased noise.

Typically, where there are multiple cylinders, the individual primary tubes are merged with a second length of exhaust tubing having a larger diameter. For purposes herein, the collection of primary tubes and, where they are merged with a second length of exhaust tubing having a larger diameter, the second length of exhaust tubing, is referred to as a "header tube" 20. The header tube is typically provided by the manufacturer of the internal combustion engine, and is typically coupled to a muffler.

The exhaust system 10 provides, at an outlet end 22 of the header tube 20, a collector or plenum chamber 24. The plenum chamber 24 has at least two ports, 26*a,* 26*b* and is preferably of a larger diameter than the header tube 20 at its outlet end 22. One of the ports 26*a* is coupled to the outlet end 22. The plenum chamber also includes an outlet 25 for conducting gases from inside the plenum chamber to the external atmosphere.

The exhaust system 10 also employs a ram tube 28 having an inlet end 30 and an outlet end 32. The other port 26*b* of the plenum chamber is coupled to the outlet end 32 of the ram tube. Preferably, the inlet end 30 of the ram tube is larger than the outlet end and, more particularly, the ram tube is preferably funnel-shaped. Also, preferably, the length of the ram tube is substantially less than the length of the header tube 20. Notwithstanding, the length and configuration of the ram tube may vary without departing from the principles of the invention.

Figure 2:
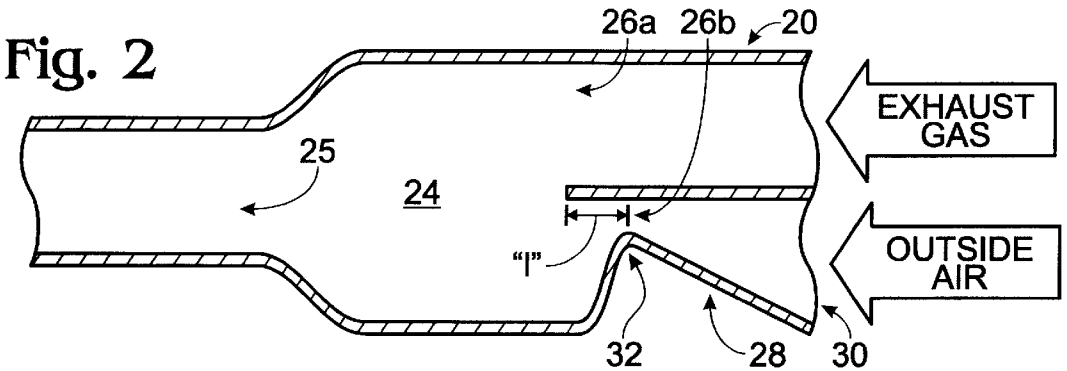
FIG. 2 is a side elevation of one portion of the exhaust system of FIG. 1.

Referring to FIG. 2, for obtaining best performance from the exhaust system 10, it is preferable to provide that the ram air port 26*b* of the plenum chamber is set-back from the header port 26*a,* in such manner that the outside air conducted by the ram tube is caused to travel inside the plenum chamber at least a set-back distance "1" before being permitted to join the stream of exhaust gas as it passes through the port 26*a.* It is believed that this feature contributes significantly to performance and efficiency increases provided by the system 10, and further contributes to superior noise reduction.

Also as shown in FIG. 2, it is preferable to employ a funneling structure at the outlet 25 of the plenum chamber 24, which is believed to provide for an additional venturi effect.

Figure 3:
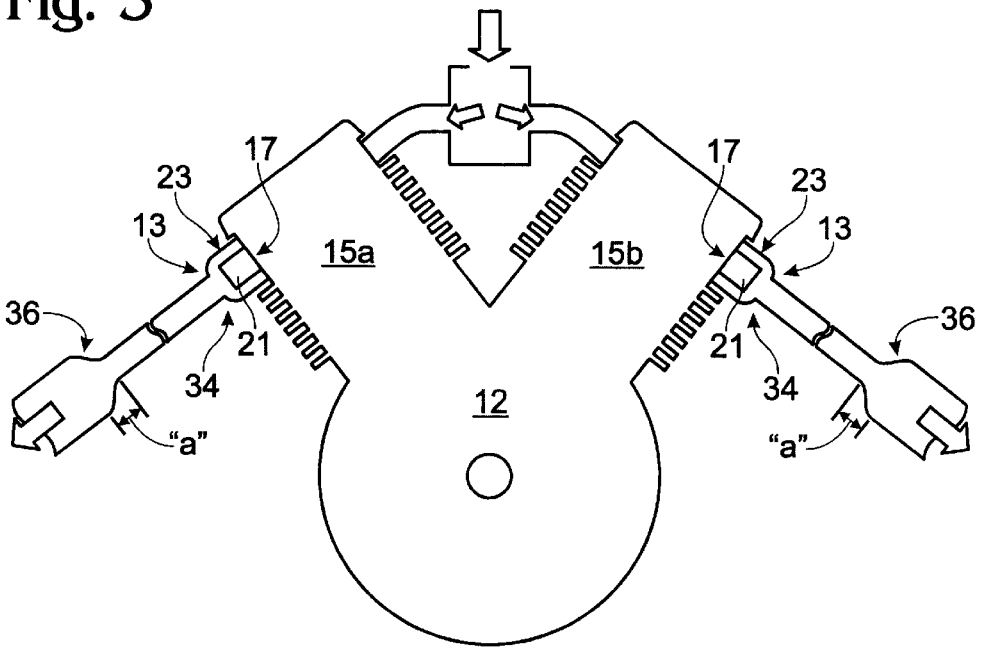
FIG. 3 is a pictorial view of another portion of the exhaust system of FIG. 1.

Turning to FIG. 3, the exhaust system 10 also preferably employs reverse flow controllers 34 at each exhaust port 17. The reverse flow controllers are passive devices comprising a relatively short length of relatively small diameter tubing 21 extending from the exhaust port 17 disposed, preferably coaxially, within a length of relatively large diameter tubing 23 that is coupled to the inlet end 13 of the associated primary tube portion of the header tube. The tubing 23 is disposed around the tubing 21 to provide a gap therebetween. It is believed that the reverse flow controllers prevent unwanted reverse flow of exhaust gas into the induction system that can occur when exhaust velocity is low and scavenging is insufficient to assist in drawing the air-fuel mixture into the cylinder. Such controllers have been commercially marketed under the trademark AR ("Anti-Reversion") by the Cyclone and Blackjack header companies, which are presently owned by Tenneco Automotive of Lake Forest, Ill.

The exhaust system 10 also preferably employs a step 36 in the diameter of the header tube or tubes. The step 36 demarcates upstream and downstream portions of the header tube or tubes, and may or may not have an associated axial length dimension "a" of its own. Upstream of the step 36, the diameter of the header tube is smaller, and downstream of the step 36, the diameter of the header tube is larger. It is believed that the step 36 when strategically positioned provides for increased engine torque at lower to mid-range engine speeds without decreasing torque at higher engine speeds. Stepped header tubes are commercially marketed under the trademark TORK-STEP by Hedman Hedders of Cerritos, Calif.

The combination of all of the aforementioned features is believed to particularly enhance the performance and efficiency of internal combustion engines in vehicles. However, it is also believed that the features may employed in selected sub-combinations, or may be employed in isolation to achieve performance and efficiency gains as well.

Figure 4:
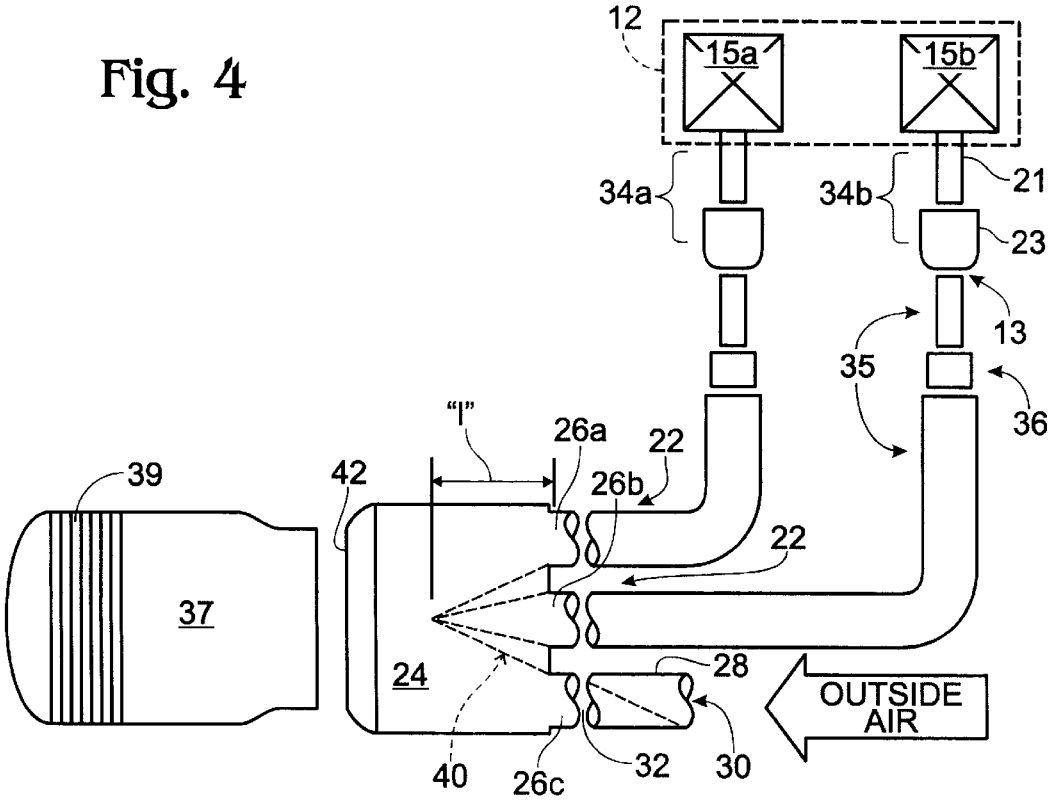
FIG. 4 is an exploded schematic view of a preferred embodiment of an exhaust system according to the present invention.

Referring to FIG. 4, a particular embodiment of the exhaust system 10 that has been implemented in a 1983 Moto-Guzzi 850 cc V-twin motorcycle has been found to provide outstanding performance and efficiency gains. The specific combinations of features, dimensions and ranges therefor provided below are for further illustrating a particular embodiment of the system 10 and shall be understood not to express or imply any limitations on the scope of the invention.

The engine 12 in this motorcycle was originally provided with separate header tubes for each cylinder 15*a,* 15*b,* i.e., the two original primary tubes were plumbed independently from respective exhaust ports to respective mufflers. For purposes of fitting the exhaust system 10, the original primary tubes were discarded and replacement primary tubes 35 were provided. For the 850 cc engine 12, the primary tubes 35 are provided with a 1⅞" diameter and 9½" to 9¾" length portion upstream of a 2" diameter and 1" long step 36, and a 2⅛" diameter and 12½" to 14" length portion downstream of the step 36.

Two reverse flow controllers 34*a* and 34*b* are provided, respectively, for each of the two cylinders 15*a,* 15*b.* The reverse flow controllers each employ a 4" length of tubing 21 having a 1⅞" diameter coaxially disposed within a 1½" long, 2½" diameter reducer 23 that is coupled to the inlet end 13 of the respective primary tube. Accordingly, the 4" length of tubing extends through the 1½" section of tubing and into the 1⅞" diameter primary tube.

A plenum chamber 24 is provided in the form of a 3½" diameter section of tubing that is 13½" to 14" long, and has three ports 26*a,* 26*b* and 26*c.* Two of the ports 26*a* and 26*b* are coupled to respective 2⅛" diameter outlet ends 22 of the header tubes 35.

The third port 26*c* is coupled to a funnel-shaped ram tube 28. The ram tube may be formed by providing an appropriate insert in a length of round tubing. The ram tube 28 is 6¾" to 9" long, has an inlet end 30 having a 3" diameter and an outlet end 32 having a 5/16" to ⅜" diameter.

The plenum chamber has a baffling surface 40 that protrudes inwardly between the header ports 26*a* and 26*b*, providing a set-back distance "1" of about 2 to 2¼" between the ports 26*a* and 26*b*, and the port 26*c*. The set-back provides that rammed air must travel past the baffling surface 40 before being able to merge with exhaust gas streaming through the ports 26*a* and 26*b*. Commercially available merged collectors may be employed as the plenum chamber 24, such as those marketed by Hooker Industries of Ontario, Calif., and are provided with the baffling surface 40 as a feature of their construction.

An outlet 42 of the plenum chamber 24 is formed as a frusto-conically shaped end portion of the plenum chamber that reduces the 3½" diameter of the plenum chamber to 2½".

It is further preferable to employ, in the system 10, a tunable muffler 37 such as that marketed by SuperTrapp Industries, Inc. of Cleveland Ohio, under the trademark SUPERTRAPP. Such mufflers employ a packed fiberglass or perforated "diffusor" tube around which is packed a sound absorptive material, and removable or adjustable baffling, such as the so-called DIFFUSER DISCS 39 in the SUPERTRAPP device. For use with the Moto Guzi motorcycle described above, a 4" diameter, 17" long SUPERTRAPP muffler with a 2½" inlet diameter was employed with 18 removable baffles or "discs."

It is to be recognized that, while particular exhaust system for an internal combustion engine according to the present invention has been shown as preferred, other configurations could be utilized, in addition to configurations already mentioned, without departing from the principles of the invention.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims that follow.

I claim:

1. An exhaust system for an internal combustion engine installed in a vehicle, comprising:

a header tube having first and second ends, said first end being adapted for coupling to the internal combustion engine for conducting a stream of exhaust gas;

a ram tube having first and second ends, wherein said first end is adapted for disposition with respect to the vehicle so as to collect a portion of the airstream produced by the vehicle as the vehicle moves forwardly, wherein said first end of said ram tube is larger than said second end of said ram tube, and wherein the length of said ram tube is substantially less than the length of said header tube; and a plenum chamber having at least two ports, wherein a first of said ports is adapted for coupling to said second end of said header tube and a second of said ports is adapted for coupling to said second end of said ram tube, wherein said second port is set-back from said first port a set-back distance of between about 2" and about 2¼" wherein outside air conducted by said ram tube is caused to travel inside said plenum chamber at least said set-back distance before being permitted to join the stream of exhaust gas as the stream of exhaust gas passes through said first port.

2. The apparatus of claim 1, further comprising a reverse flow controller disposed downstream, with respect to said stream of exhaust gas, of the internal combustion engine, said reverse flow controller comprising a first length of tubing having a first diameter and a second length of tubing having a second diameter greater than said first diameter, said second length of tubing being disposed around said first length of tubing so as to create a gap therebetween.

3. The apparatus of claim 1, wherein said header tube has a first diameter portion and a second diameter portion downstream, with respect to said stream of exhaust gas, of said first diameter portion, wherein the diameter of said first diameter portion is substantially smaller than the diameter of said second diameter portion.

4. The apparatus of claim 2, wherein said header tube has a first diameter portion and a second diameter portion downstream of said first diameter portion, wherein the diameter of said first diameter portion is substantially smaller than the diameter of said second diameter portion.

5. The apparatus of claim 1, wherein said plenum chamber includes an outlet adapted for conducting exhaust gas passing through said first port and outside air passing through said second port therefrom, and further comprising a tunable muffler adapted for adjusting the amount of back-pressure caused thereby.

6. The apparatus of claim 2, wherein said plenum chamber includes an outlet adapted for conducting exhaust gas passing through said first port and outside air passing through said second port therefrom, and further comprising a tunable muffler adapted for adjusting the amount of back-pressure caused thereby.

7. The apparatus of claim 3, wherein said plenum chamber includes an outlet adapted for conducting exhaust gas passing through said first port and outside air passing through said second port therefrom, and further comprising a tunable muffler adapted for adjusting the amount of back-pressure caused thereby.

8. The apparatus of claim 4, wherein said plenum chamber includes an outlet adapted for conducting exhaust gas passing through said first port and outside air passing through said second port therefrom, and further comprising a tunable muffler adapted for adjusting the amount of back-pressure caused thereby.

9. The apparatus of claim 1, wherein said plenum chamber includes an outlet adapted for conducting exhaust gas passing through said first port and outside air passing through said second port therefrom, said outlet including at least a portion that tapers diminishingly in the direction of gas flow.

10. The apparatus of claim 9, further comprising a tunable muffler adapted for adjusting the amount of back-pressure caused thereby.

11. An exhaust system for an internal combustion engine installed in a vehicle, comprising:

a ram tube adapted to conduct outside air having first and second ends in fluid communication with one another, wherein said first end is adapted for disposition with respect to the vehicle to collect a portion of the airstream produced by the vehicle as the vehicle moves forwardly, wherein said first end is larger than said second end;

a plenum chamber having at least two ports, wherein a first of said ports is adapted for receiving exhaust gases from the internal combustion engine and a second of said ports is adapted for coupling to said second end of said ram tube, wherein said second port is set-back from said first port a substantially non-zero set-back distance such that outside air conducted by said ram tube is caused to travel inside said plenum chamber at least said set-back distance before being permitted to join the stream of exhaust gas as the stream of exhaust gas passes through said first port; and a reverse flow controller disposed downstream of and proximate to the internal combustion engine, comprising a first length of tubing having a first diameter and a second length of tubing having a second diameter greater than said first diameter, said second length of tubing being disposed around said first length of tubing so as to create a gap therebetween.

12. The apparatus of claim 11, further comprising a header tube having first and second ends in fluid communication with one another, wherein said first end is adapted for coupling to the internal combustion engine and said second end is adapted for coupling to said first port of said plenum chamber, said header tube having a first diameter portion and a second diameter portion downstream of said first diameter portion, wherein the diameter of said first diameter portion is substantially smaller than the diameter of said second diameter portion.

13. The apparatus of claim 11, wherein said plenum chamber includes an outlet adapted for conducting exhaust gas passing through said first port and outside air passing through said second port therefrom, and further comprising a tunable muffler adapted for adjusting the amount of back-pressure caused thereby.

14. The apparatus of claim 12, wherein said plenum chamber includes an outlet adapted for conducting exhaust gas passing through said first port and outside air passing through said second port therefrom, and further comprising a tunable muffler adapted for adjusting the amount of back-pressure caused thereby.

15. The apparatus of claim 11, wherein said plenum chamber includes an outlet adapted for conducting exhaust gas passing through said first port and outside air passing through said second port therefrom, said outlet including at least a portion that tapers diminishingly in the direction of gas flow.

16. The apparatus of claim 15, further comprising a tunable muffler adapted for adjusting the amount of back-pressure caused thereby.

* * * * *